United States Patent [19]

Skalleberg

[11] 4,098,468

[45] Jul. 4, 1978

[54] REELING DEVICE FOR CABLES

[75] Inventor: Öysten Skalleberg, Järfälla, Sweden

[73] Assignee: Skaltek AB, Kungsangen, Sweden

[21] Appl. No.: 781,133

[22] Filed: Mar. 25, 1977

[30] Foreign Application Priority Data

Mar. 29, 1976 [SE] Sweden ..... 7603752

[51] Int. Cl.[2] ..... B65H 75/00

[52] U.S. Cl. ..... 242/54 R; 242/68.4; 242/85

[58] Field of Search ..... 242/54 R, 58.6, 85, 242/86, 86.2, 77, 68, 68.4; 214/392, 394, 396

[56] References Cited

U.S. PATENT DOCUMENTS

| | | | |
|---|---|---|---|
| 2,706,057 | 4/1955 | Belding | 214/392 |
| 3,123,314 | 3/1964 | Bruestle | 242/54 R |
| 3,687,385 | 8/1972 | Skalleberg | 242/54 R |
| 4,030,704 | 6/1977 | Beierle | 242/85 |

*Primary Examiner*—Edward J. McCarthy
*Attorney, Agent, or Firm*—Brown, Murray, Flick & Peckham

[57] ABSTRACT

A cable reeling device for winding cable upon a flanged reel comprising support means slidable along vertical side-frames and supporting a spindle, the support means being interconnected by means of an extendable shaft, in which each support means comprises a power means for moving said spindles between a first position, in which the spindle is able to freely move within a zone around intended position of the axis of the reel and a second position fixed in relation to the support means for carrying the reel turnably on the spindles.

10 Claims, 2 Drawing Figures

REELING DEVICE FOR CABLES

The present invention relates to a reeling device and specially to a reeling device for reeling cables on a reel having a centre hole. The device according to the invention can be used for many purposes, but as it has been developed mainly for handling electric cables, the invention will be described in connection with such cables.

When manufacturing electric cables, the cable is reeled in continuous lengths on reels for storing, distribution and laying operations. Thus, in cable manufacturing it is common to reel cables on reels or to reel them off from the reels, and because of the fact that the reels are large and heavy it is necessary to provide large and heavy devices for the reeling. It is desirable that the reeling devices be constructed for handling reels with different diameters and with different lengths. These are demands which per se are possible to satisfy, but there are many practical difficulties regarding manufacturing costs, distribution possibilities, limited spaces and so on.

Known reeling devices ordinarily comprise two rigid side-frames, the upper ends of which are interconnected by means of a shaft. The reel on which the cable is to be reeled is rotatably mounted on strong spindles, which can be introduced in both ends of the centre hole in the reel. As reels mostly are very heavy, the spindles must be raised and lowered by means of motors or hydraulic cylinder. Further, the floor space between the side-frames must be available, in order to make it possible to roll the reels into a position between the side-frames so that the spindles can be introduced into the centre hole of the reel and so that the reel can be raised. As the reels used are of different dimensions the side-frames have to be high enough in order to make it possible to handle reels with a large diameter and further the spindles have to be movable far enough away from each other to make it possible to handle long reels. This can be accomplished by varying the distance between the side-frames or by placing the spindles on arms hanging down from the shaft between the side-frames, whereby at least one of the arms is movable along the shaft. From manufacturing and constructional point of view this last type, i.e. with hanging arms, is easiest to manufacture, and thus most common. The arms are telescopically extendable, so that the spindles in the free ends of the arms can be raised and lowered in order to place the spindles in horizontal alignment with the reel centre for introducing the spindles in the hole of the reel and lifting the same.

In practice, it is difficult to position a reel with the centre hole in alignment with the spindles. The reason for this is, that it is almost impossible to roll a very heavy reel between the side frames so that the centre axis of the reel is positioned exactly perpendicular to the side-frames and in alignment with the spindles. Further it is difficult to raise or lower the lifting arms to a proper position in horizontal alignment with the reel centre. Thus, it is obvious that positioning and hanging a cable reel in a reeling device is difficult and time-consuming. The problems involved with oblique reel axes and vertical positioning of the spindles in relation to the reel axes are well known in the art. It is true that the spindles, which usually are tapered, can be introduced in the centre hole, but during this the reel must be tilted, which results in strains in the reeling device.

A further disadvantage in known reeling devices having telescopically extendable lifting arms is that reels with small diameters have to be raised relatively high prior to reeling a cable. The reason for this is that the two parts of each telescopically extendable arm are not guided in relation to each other when the arms extended as much as possible. Further, if a reel with relatively small diameter is positioned only a short distance above the ground when reeling cable, very strong stresses appear in the lifting arms on account of dynamic forces from the rotating reel. Small reels are especially used for cables with relatively small dimensions, and manufacturing and handling such a cable is carried out at high feeding speeds. This means that the reel has to rotate with high speed and any eccentricity in the reel results in serious vibrations. In order to obtain proper guiding between the two parts of the lifting arms, the reel thus has to be raised more than a short distance from the floor, which is time consuming and results in a high centre of gravity. Of course, this in turn results in stronger dynamic stresses in the reeling device in comparison with a case where the reel can be held just above the ground.

It is an object of the invention to provide a reeling device which in a proper way solves the abovementioned problems and which eliminates the drawbacks in known reeling devices. The reeling device according to the present invention makes it possible to easily insert the spindles in the centre hole in a reel. The spindles are movable between a first position in which the spindles are able to freely move within a zone around an intended position of the axis of the reel and a second position fixed in relation to support means for carrying the reel turnably on the spindles.

It is another object of the invention to provide a reeling device in which the spindles are mounted on a link system which is coupled to a power means for alternatively placing the spindles in the first, free position and the second, fixed position.

It is a further object of the invention to provide support arms for carrying the power means, which arms at one end are journalled in the support means around a shaft permitting the support arms to swing in a vertical plane.

It is another object of the invention to provide means for fixing the support arms on side-frames when the spindles are placed in the second, fixed position.

Other objects and features of the invention will be apparent when the following description is considered in connection with the drawings, in which.

Figure 1:
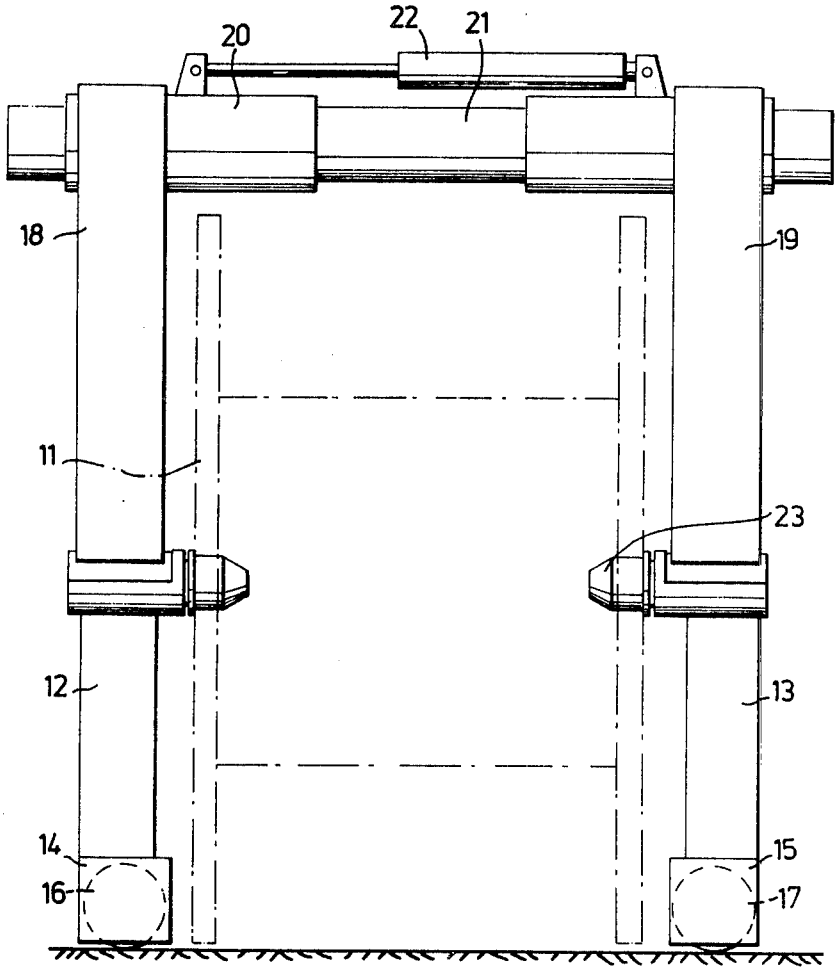
FIG. 1 is a front view of a reeling device according to the invention.
Figure 2:
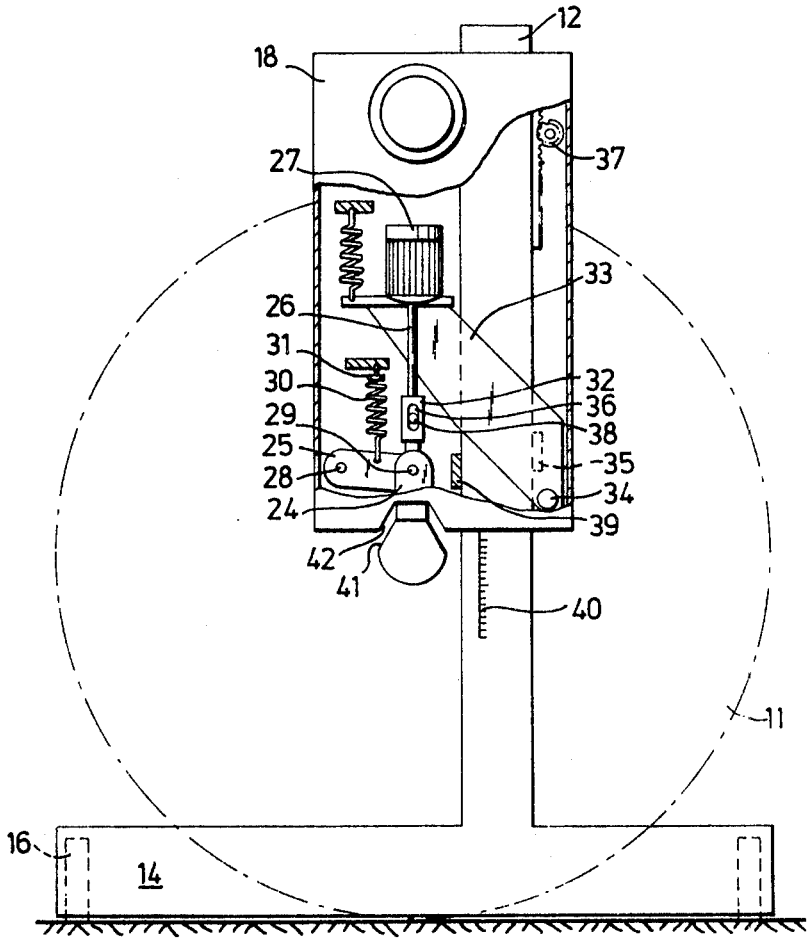
FIG. 2 is a side view of the reeling device according to FIG. 1.

A reeling device according to the invention intended for winding cable on a reel 11 is supported by means of two side-frames 12, 13 fixed on a base 14, 15, respectively. The bases are movable on the ground by means of wheels 16, 17. Each side-frame 12, 13 supports a support housing 18, 19, vertically displaceable on the side-frames 12, 13. The two support housings 18, 19 are interconnected by means of a horizontal, telescopically extendable shaft 20, 21. Thus, the support housings 18, 19 and the extendable shaft 20, 21 together form a unit which is vertically movable along the side-frames 12, 13.

The distance between the side-frames 12, 13 can be regulated by changing the length of the shaft 20, 21 by means of a hydraulic cylinder 22, whereby the side-frames 12, 13 roll on the wheels 16, 17 in the bases 14, 15. In each support housing 18, 19 a link system comprising two links 24, 25 is arranged, the link system supporting a spindle 23 for the reel 11 and being mechanically coupled by means of a tie-rod 26 to a hydraulic cylinder 27. The link 25 is at one end turnable around a horizontal shaft 28, which is fixed in the support housing. The other end of link 25 is turnably journalled by means of a pin 29 in one end of the other link 24, the other end of which supports the spindle 23. The link system is balanced against gravity by means of a spring 30. This spring 30 is fixed in the support housing 18, 19, preferably by means of an adjustable screw 31. The mechanical coupling between the link system 24, 25 and the tie-rod 32 can be shaped like a sleeve 26, slidable a short distance along the tie-rod and provided with axially extending slots 36, in co-operation with a pin 38 in the tie-rod 26, or be formed as a chain (not shown).

The hydraulic cylinder 27 is supported on one end of a support arm 33, the other end of which is journalled on a shaft 34 in the support housing and slidable along the side-frame 12, 13 on a bearing member 35. Thus, the support arm 33 is swingable in a vertical plane and slidable together with the support housing 18, 19 up and down along the side-frame 12, 13.

Adjusting the side-frames 12, 13 vertically is carried out by means of a rack gear 37, whereby the support housings 18, 19 slide on the side-frames 12, 13 on bearing areas (not shown) while the support arms 33 are sliding on their bearing member 35. Further at least one side-frame can be provided with a scale 40 for indicating proper position corresponding to different reel diameters.

When lifting a reel, the reel is rolled in position between the side-frames 12, 13 and the support housings 18, 19 are adjusted into a position according to the reel diameter. The tie-rods 26 are lowered in the support housings so that the sleeves 32 can slide a short distance along the tie-rods 26 and so that the link systems 24, 25 are hanging on the springs 30. Thus, the spindles 23 are free to move within a zone permitted by the link systems 24, 25 in different directions in relation to the axis of the reel, so that they easily can be positioned in alignment with the centre hole in the reel. If the spindles 23 then are positioned approximately in alignment with the centre hole, they can, as they are tapered, be inserted in the centre hole in the reel, when the extendable shaft 20, 21 is shortened. If, on the contrary, the spindles 23 are positioned at the side of the hole, it is possible to manually position the spindles during the shortening of the shaft 20, 21. When the spindles 23 are inserted in the reel hole, the tie-rods 26 are drawn upwards by means of the hydraulic cylinders 27, so that the link system 24, 25 is raised.

In order to effectively fix the link system to the support housings 18, 19 one of the links is provided with a wedge-shaped projection 41, which is pressed against shoulders 42 in the support housings 18, 19. After that the pressure in the hydraulic cylinders 27 can be raised so that the links 24 and the tie-rods 26 are stressed between the shoulders 42 and the free ends of the support arms 33. When doing so, the bearing members 35 are pressed against the corresponding side-frame so that the support arms 33 are fixed in desired position. As the support arms 33 are journalled in the support housings, the latter are fixed on the side-frames. Preferably a bearing member 39, fixed in each support housing, is provided as holder-on or brake for this fixing of the support arms and the support housings.

Because of the fact that the spindles in a reeling device according to the invention are supported by means of link systems, which can be brought in a freely hanging position, the positioning of the support housings 18, 19 in a vertical direction on the side-frames can be carried out roughly when a reel is to be mounted in the reeling device. This makes it possible to mount the support arms 33 and the support housings 18, 19 on the side-frames 12, 13 in the described simple way. Thus, under unloaded conditions, the support housings and the support arms can, sliding on the bearing areas, be raised and lowered along the side-frames. Under loaded conditions, however, the support arms and the support housings are effectively fixed on the side frames.

Thus, it is obvious that the reeling device according to the invention solves all the problems which are involved in constructing a reeling device, and all drawbacks in known reeling devices are eliminated. For instance, the spindles can easily be inserted in the centre hole of the reel, independent of any obliqueness between the axis of the reel and the spindles. Further, the control device for positioning the support housings along the side-frames can be manufactured without high accuracy as positioning of the support housings can be carried out roughly. Further, a reel member may be raised more than a short distance above the floor in connection with winding a cable on the reel, as the spindles always are effectively fixed in the fixed position in the link systems, independent of the height of the spindles. The dynamic moment during reeling a cable, especially at high feeding speeds, is then reduced to a minimum. Further, a cross-bar, which usually interconnects the upper ends of the side-frames in known reeling devices can be eliminated, as the support housings are interconnected by means of the extendable shaft. This results in the advantage that the side-frames in a reeling device according to the invention are mutually fixed in a lower position the lower a reel is positioned, so that a higher stability is obtained in comparison with known reeling devices having a cross-bar interconnecting the upper ends of the side-frames. Thus, bending stresses due to high forces, can be reduced to a minimum.

I claim:

1. A cable reeling device for winding cable and the like upon a flanged reel having central spindle-receiving openings, said device comprising a pair of laterally spaced vertical side-frames two support members each slidable vertically along one of said side-frames, a pair of spindles each supported by one of said support members, longitudinally adjustable means interconnecting said support members for holding the side-frames in position to receive a reel between the spindles, power means supported by said support members for moving the spindles between a first position in which they are freely movable relative to the support members within a zone around the intended position of the reel axis to permit insertion of the spindles into the reel openings when the side-frames are adjusted toward each other, and a second position fixed in relation to the support members for then rotatably supporting a reel on the spindles.

2. A cable reeling device according to claim 1, including at least two interconnected links coupled to each power means, and each of the spindles being fixed on one of each two interconnected links.

3. A cable reeling device according to claim 2, including springs connected with said links for balancing them against gravity when placed in said first position.

4. A cable reeling device according to claim 2, in which said links are coupled to said power means by connecting members capable of withstanding only tension forces thereon.

5. A cable reeling device according to claim 1, including a link coupled to each power means, one of the spindles being mounted on each link and the links being provided with projections and the support members being provided with shoulders engageable by said link projections in said second position of the spindles.

6. A cable reeling device according to claim 1, including a support arm pivotally mounted in each support member in sliding engagement with the adjoining side-frame, said power means being mounted on one end of the support arm.

7. A cable reeling device according to claim 6, including a shaft pivotally connecting each support arm to the adjoining support member on a horizontal axis to permit the arm to swing in a vertical plane.

8. a cable reeling device according to claim 7, including a bearing member on each support arm adjacent said shaft for sliding engagement with the adjoining side frame and for pressing against the side frame when said power means is activated, whereby to fix the support arm on the side-frame.

9. A cable reeling device according to claim 8, including a bearing member rigidly mounted in each support member in sliding engagement with the side of the adjoining side-frame opposite said first-mentioned bearing member.

10. A cable reeling device according to claim 1, including a graduated scale on at least one of said side-frames for indicating proper height of the support members on the side-frames for different reel diameters.

* * * * *